US005163572A

United States Patent [19]

Gerhard

[11] Patent Number: 5,163,572

[45] Date of Patent: Nov. 17, 1992

[54] TANK CONTAINER

[75] Inventor: Helmut Gerhard, Weitefeld, Fed. Rep. of Germany

[73] Assignee: Westwaelder Eisenwerk Gerhard GmbH, Fed. Rep. of Germany

[21] Appl. No.: 759,907

[22] Filed: Sep. 13, 1991

[30] Foreign Application Priority Data

Sep. 24, 1990 [DE] Fed. Rep. of Germany ... 9013453[U]

[51] Int. Cl.[5] ..... B65D 88/06

[52] U.S. Cl. ..... 220/1.5; 220/4.12

[58] Field of Search ..... 220/1.5, 4.12, 401, 220/562, 565

[56] References Cited

U.S. PATENT DOCUMENTS

| | | | |
|---|---|---|---|
| 3,814,290 | 6/1974 | Gerhard | 220/4.12 X |
| 4,805,794 | 2/1989 | Tsuchiya et al. | 220/1.5 X |
| 4,807,777 | 2/1989 | Berwald et al. | 220/1.5 X |
| 4,905,854 | 3/1990 | Gerhard | 220/1.5 |

*Primary Examiner*—Steven M. Pollard

*Attorney, Agent, or Firm*—Evenson, Wands, Edwards, Lenahan & McKeown

[57] ABSTRACT

The bottom structure of small and medium size tank containers includes a pair of longitudinal fork lift channels and a pair of tranverse fork lift channels extending perpendicularly of the longitudinal channels. The transverse channels are defined by gaps between portions of profile bars forming the longitudinal channels. The profile bar portions are equipped with bottom plates which have openings for engagement by locking members provided on the loading platforms of vehicles. Locking plates are further provided at the bottoms of end frames of the tank container, each locking plate having a plurality of further openings for engagement by locking members as commonly provided on road and railway vehicles for ISO containers. A portion of an upper transverse bar of each end frame is formed as a grappler arm pocket provided with an upper guide plate. An upper portion of the guide plate forms an eye reinforced by a transverse member for engagement by a crane hook.

11 Claims, 3 Drawing Sheets

TANK CONTAINER

BACKGROUND OF THE INVENTION

In addition to ISO containers which have outer dimensions between 10 and 40 feet (approximately 3 and 12 m) in length and 8 feet (approximately 2.4 m) in width, as common in the international container traffic, small and medium size containers, specifically tank containers, are increasingly used. With these smaller containers, there is regularly the problem that, due to their dimensions and fittings, they cannot be combined with ISO unit loads and cannot be handled and secured by means of handling and locking devices provided for ISO containers. Moreover, there are frequently customer specifications concerning the handling and securing of medium and small size containers.

U.S. Pat. No. 4,905,854 discloses a smaller than standard size container which comprises a tank disposed between a pair of end frames and a base structure connected to the end frames and having pockets defining two pairs of fork lift channels extending perpendicularly of each other.

SUMMARY OF THE INVENTION

It is an object of the invention to provide a tank container which permits universal handling and securing by inexpensive means.

To meet this object, the tank container of the present invention comprises a tank disposed between a pair of end frames and a base structure connected to the end frames and having a pair of fork lift channels, wherein the fork lift channels are formed by profile bars extending in the direction of the longitudinal tank axis and having a downwardly open U-profile, and wherein bottom plates each having an opening for engagement by a locking member for securing the container to a vehicle loading area are disposed at locations symmetric with respect to the transverse tank axis, said bottom plates interconnecting the lower legs of the U-profile bars.

According to the invention, bottom plates each having an opening for engagement by a locking member are arranged within the base structure to replace or supplement any corner fittings that may be provided. The mutual spacing between the securing points formed by the base plates may be substantially smaller than that defined by any corner fittings and may be provided in accordance with locking facilities available on special vehicles.

In a preferred embodiment of the invention, the profile bars forming longitudinal fork lift channels are interrupted by gaps which define a pair of transverse fork lift channels extending parallel and symmetrically to the transverse tank axis. Two pairs of mutually perpendicularly extending fork lift channels are thus formed in the base structure of the tank container in a particularly inexpensive and light-weight manner. The tank container may therefore be handled by fork lifts in both its longitudinal and transverse directions, which is desirable especially with medium and small size containers having a substantially square base.

According to further embodiments, the three profile bar portions of either longitudinal fork lift channel are connected at their respective ends to lower transverse bars of the end frames and to lower bearing plates of two supports connected to the tank. Further an intermediate bearing plate mounted on the tank may be provided between the two supports disposed on the same transverse axis, the lower surfaces of all bearing plates being flush with the upper confining plane of the respective transverse fork lift channel. These features result in a particularly stiff base structure with a minimum of additional structural elements.

According to further embodiments, locking plates are provided at the lower side of each end frame, each locking plate having a plurality of openings at mutual center spacings of substantially 140 mm for selective engagement by locking members for securing the container to a vehicle loading area. Preferably, the locking plates are spaced in the direction of the longitudinal tank axis by substantially 2,260 mm as measured between the centers of the respective openings. The selected spacing between the locking plates permits the tank container to be secured to pairs of locking members as are usually provided on platforms of ISO road and railway vehicles at a mutual spacing of 280 mm. The plurality of openings mutually spaced at 140 mm results in a plurality of possible locking positions with optimum usage of the available loading area.

In a further embodiment of the invention, the outer end of each locking plate is aligned with the farthest projecting portion of the tank container, and the inner end of each locking plate is in the area of the longitudinal tank axis. The farthest projecting portion of the tank container may be constituted by a dump body stud, and the outer portion of the locking plate extending beyond the width of the end frame is adapted to be folded upwardly. Thus, since the locking plates extend over about one-half of the container width, and in view of the fact that the container may be rotated by 180°, a maximum number of possible locking positions is achieved. At the same time, the locking plates serve to protect the tank, without impeding the handling of the container by means of the dump body studs.

In another embodiment of the invention, a portion of an upper transverse bar of each end frame is formed as a grappler arm pocket provided with an upwardly extending guide plate. The upper portion of the guide plate has an eye reinforced by a transverse member for engagement by a crane hook. The transverse member constitutes the apex of a triangular support structure, of which the base is formed by the upper transverse bar of the end frame, one leg is formed by the guide plate and the other leg is formed by connecting plates fixed to the upper transverse bar. A highstrength, yet light-weight structure is thus achieved which permits the handling of the tank container by grappler arms or crane hooks.

DETAILED DESCRIPTION OF A PREFERRED EMBODIMENT

Figure 1:
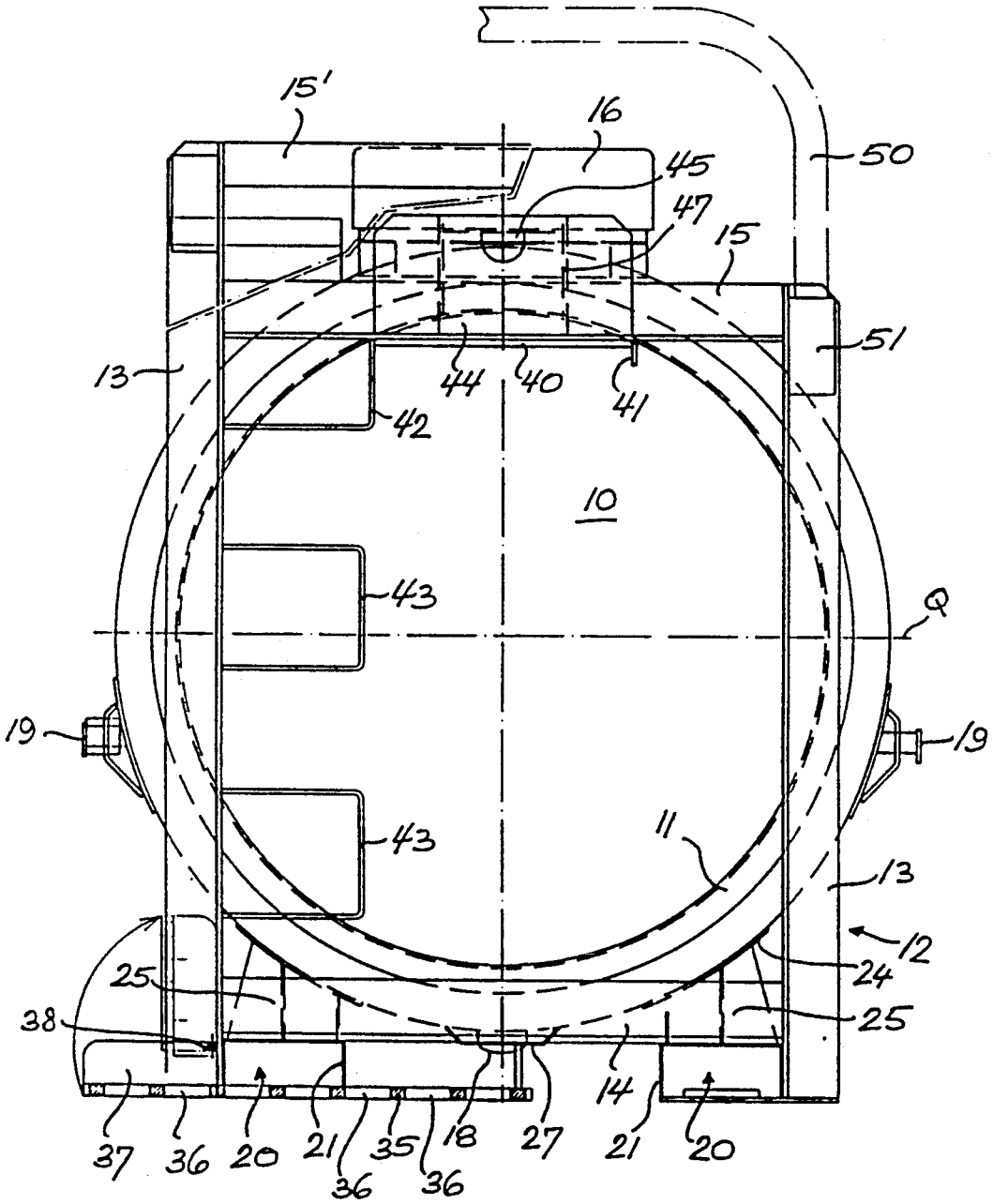
FIG. 1 is an end view of a tank container.

The tank container illustrated in the drawings comprises a tank 10 which is connected via end rings 11 to a pair of end frames 12. Each end frame 12 is formed of two corner struts 13, a lower transverse bar 14 and an upper transverse bar 15. The corner struts 13 and the upper transverse bar 15 are formed of L-bars, and the lower transverse bar 14 is formed of a T-bar, with the vertical flanges of all four bars being disposed in one common plane. The end rings 11 have an L-shaped cross-section, with the peripheral flange extending parallel to the longitudinal tank axis L being welded to the respective tank bottom and the flange extending perpendicularly to the peripheral flange being welded to the flanges of the corner struts 13 and transverse bars 14, 15.

The top of the tank 10 is provided with tank armatures 17 covered by a cap 16. The tank bottom has a discharge opening 18. A pair of horizontally spaced dump body studs 19 is provided on either side of the tank shell.

Figure 2:
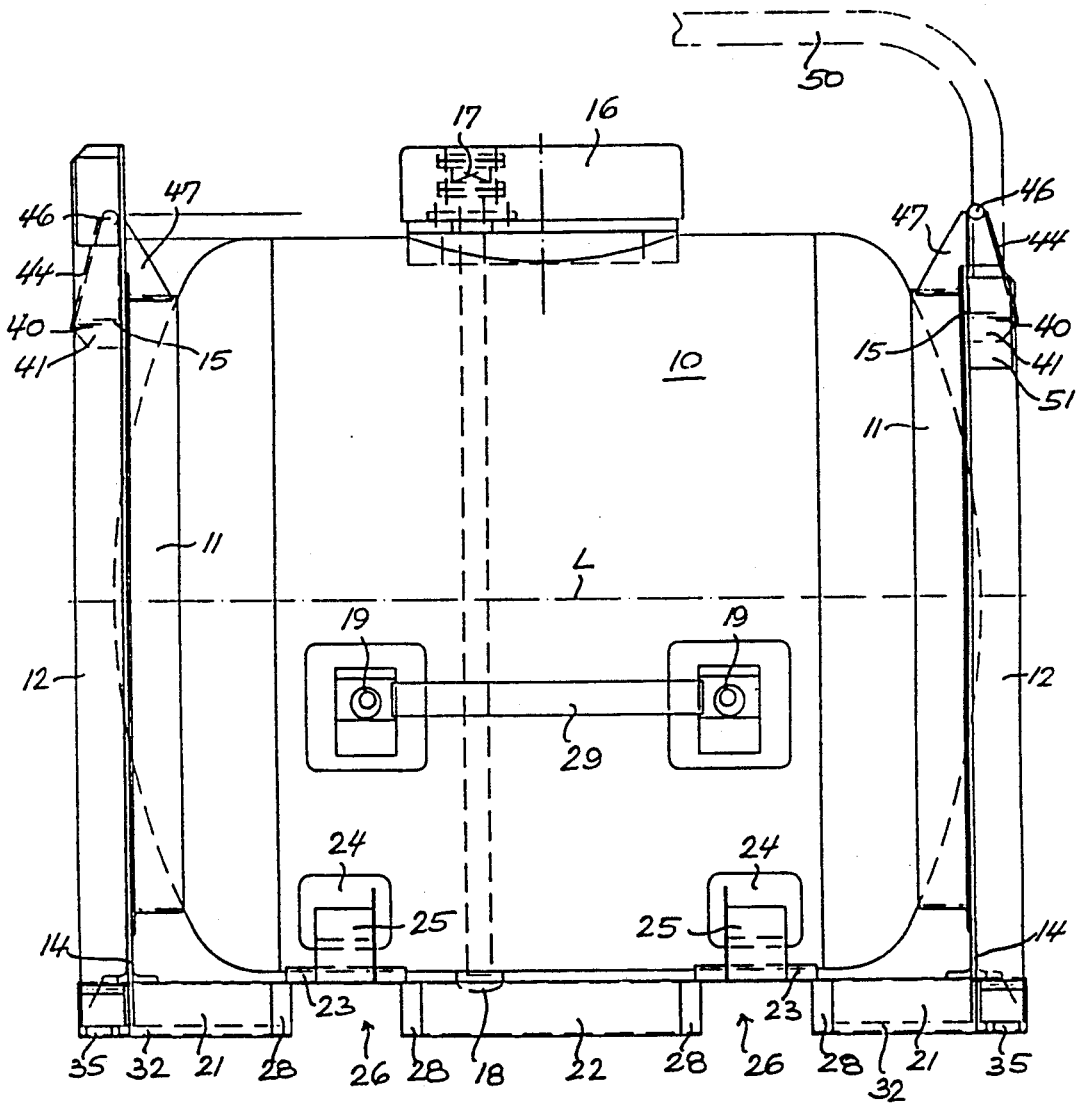
FIG. 2 is a side view of the tank container shown in FIG. 1.

The base structure of the tank container is formed by a pair of longitudinal fork lift channels extending symmetrically and parallel to the longitudinal tank axis L. As shown in FIG. 2, each longitudinal channel 20 comprises three portions 21, 22 of a profile bar. The outer bar portions 21 have their outer ends connected to the lower transverse bar 14 of the respective end frame 12 and their inner ends connected to a lower bearing plate 23 of a respective support 25 welded to the tank shell through a reinforcing plate 24. Both ends of the middle profile bar portion 22 are connected to a respective bearing plate 23.

According to FIG. 2, the inner end of each profile bar portion 21 is spaced from the adjacent end of the middle profile bar portion 22 by a gap which corresponds to the clear width of a fork lift channel. These gaps in the longitudinal fork lift channels 20 define a pair of transverse fork lift channels 26 extending symmetrically and parallel to the transverse tank axis Q.

The transverse channels 26 are thus defined laterally by the mutually facing ends of the profile bar portions 21, 22 forming the two longitudinal channels 20 and upwardly by the lower surfaces of the bearing plates 23. For additional support of the tank 10 on fork lift arms inserted into the transverse channels 26, intermediate bearing plates 27 are welded to the tank shell which are shown in FIGS. 1 and 3 and are disposed symmetrically with respect to the longitudinal tank axis L.

A pair of short sheet metal pieces 28 are formed by bending or welding on the outer sides of the mutually facing ends of the profile bar portions 21 and 22 to form outwardly opening funnel-shaped structures that facilitate the insertion of fork lift arms into the transverse channels 26.

Figure 3:
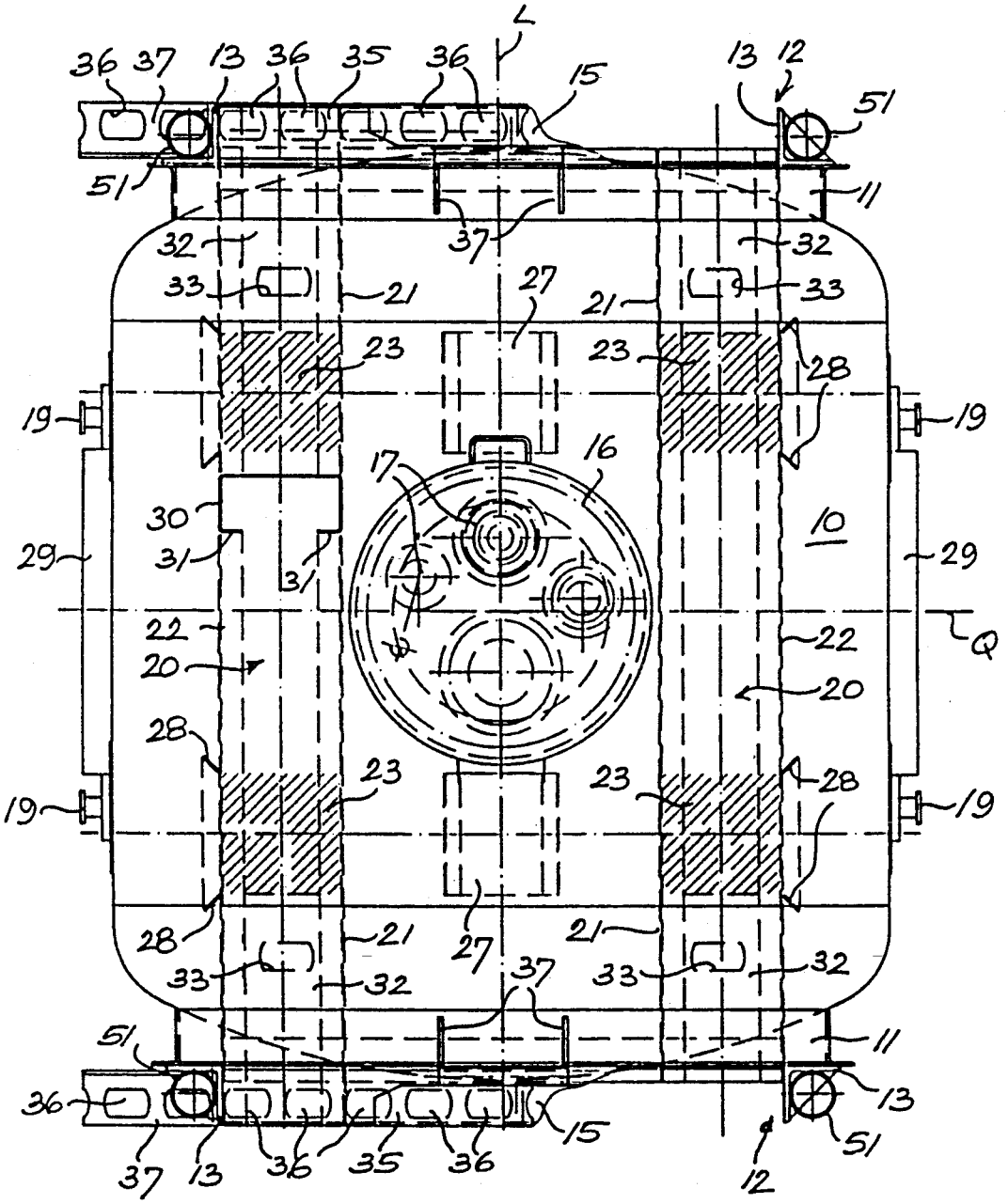
FIG. 3 is a top view of the tank container shown in FIGS. 1 and 2.

As should be clear from the above description, the two pairs of longitudinal and transverse fork lift channels 20, 26 intersect each other in the four hatched areas shown in FIG. 3 which are symmetrical with respect to the longitudinal and transverse tank axes L, Q. These areas are disposed below the four bearing plates 23 which are connected to the tank 10 via the supports 25 to ensure load forces of the tank 10 to be directly transmitted to the fork lift vehicle in the predetermined manner irrespective of the direction in which the hoisting vehicle engages the tank container.

The three profile bar portions 21, 22 of the longitudinal fork lift channels 20 have a generally U-shaped cross-section, with the free edges of the two outer legs being bent towards each other. This results in the profile 30 shown in FIG. 3. The lower flanges 31 of the profile 30 define the support plane of the tank container.

A bottom plate 32 is inserted in the two outer profile bar portions 21 of each longitudinal channel 20 and interconnects the flanges 31 by being welded thereto. Each bottom plate 32 is provided with an opening 33 which has a shape corresponding to the bottom opening of an ISO corner fitting and serves for engagement by an ISO twist lock or similar locking member.

A locking plate 35 extending parallel to the transverse tank axis Q is mounted on the lower side of each end frame 12. The outer end of each locking plate 35 lies in the vertical plane in which those portions of the tank container end which project farthest therefrom. In the present case, these portions are the dump body studs 19 and protective tubes 29 which are disposed between the studs 19 and form abutment, wear and crush elements. The other ends of the locking plates 35 extend somewhat beyond the longitudinal tank axis L.

Each locking plate 35 has seven complete openings 36. Just as the openings 33 in the four bottom plates 32, each of the openings 36 in the locking plates 35 has a shape which corresponds to that of the lower opening in an ISO corner fitting and serves for engagement by pins, twist locks or similar locking members common on ISO road and railway vehicles for container transportation.

Adjacent openings 36 have a center spacing of 140 mm in the direction of the transverse tank axis Q. ISO road and railway vehicles usually have pairs of locking members with a mutual spacing of 280 mm. Therefore, the tank container described above may be locked to the platform in a plurality of positions spaced from each other by 140 mm in the longitudinal direction. This permits optimum use of the available loading area. In the direction of the longitudinal tank axis L, the locking plates 35 are so disposed that the centers of the openings 36 are spaced by 2,260 mm, which corresponds to the spacing of opposite locking members provided on conventional ISO road and railway container transport vehicles.

The fact that the two locking plates 35, in the direction of the transverse longitudinal axis Q, extend from the plane of the farthest projecting portions of the tank container beyond the center of the container, in connection with the possibility of locking a container both in the orientation shown in FIG. 3 and in an orientation rotated by 180°, increases the overall number of possible locking positions and the optimum usage of the available platform area.

On the other hand, in order to permit unimpeded access to the dump body studs 19 for the handling and transportation of the container by means of common dump body truck systems, the outer portions 37 of the locking plates 35 may be pivoted about the axis 38 shown in FIG. 1 and folded into the profile of the corresponding corner strut 13. In both its horizontal and its upwardly folded positions, the outer portion 37 of the locking plate 35 may be secured by suitable fixing means (not shown).

Referring to FIGS. 1 and 2, the horizontal flange of the upper transverse bar 15 is formed as a grappler arm pocket 40 which is limited to the right in FIG. 1 by a stop member 41 and to the left by the vertical leg of a ladder bracket 42. The ladder bracket 42 is formed of bent round bar steel, with the vertical leg being welded to the upper transverse bar 15 and the horizontal leg welded to the left-hand corner strut 13. Further provided are a number of ladder stirrups 43 also formed from round bar steel which have their two horizontal legs connected to the left-hand corner strut 13 of the end frame 12 shown in FIG. 1.

The grappler arm pocket 40 has an upwardly extending guide plate 44 provided in its upper portion with an eye 45 for engagement by a crane hook. The upper edge of the eye 45 is reinforced by a transverse member 46 formed from round bar steel welded to the back of the guide plate 44 and to the outer edges of triangular connecting plates 47 which extend parallel to each other and to the longitudinal tank axis L and have their lower edges welded to the circumferential flange of the corresponding end ring 11.

In the side view shown in FIG. 3, the transverse member 46 forms the apex of a triangular support structure, the base of which is constituted by the horizontal flange of the upper transverse bar 15 of the respective end frame 12; the leg of the triangle adjacent the tank 10 is formed by the outer edges of the triangular connecting plates 47, and the leg remote from the tank 10 is formed by the guide plate 44. This results in a high-strength configuration that permits lifting the tank container by engagement of two crane hooks at two points situated above the longitudinal tank axis L.

In FIGS. 1 and 2, the upper transverse bar 15 has been shown at a lower location (in the right-hand portion of the respective drawing) and at a higher location (in the left-hand portion of FIG. 1). In the higher location, the upper edge of the transverse bar 15' is above the plane of the armature covering cap 16 and has function of a roll bar.

In the lower location of the transverse bar 15, a roll bar type protection can be formed by additional U-shaped brackets 50 formed of tubes which have their lower ends inserted in sleeves 51 welded in the L-profile of the corner struts 13 at the upper ends thereof (FIG. 3). The brackets 50 may be disposed either parallel to the transverse tank axis Q as shown in FIG. 1 or parallel to the longitudinal tank axis L as shown in FIG. 2. They may also serve as hand rails for service personnel.

I claim:

1. A tank container comprising a pair of end frames, a tank connected to said end frames and defining a longitudinal axis, a base structure connected to said end frames and said tank and having a pair of longitudinal fork lift channels which extend parallel to said longitudinal axis and are formed by profile bars having a downwardly open U-profile with lower flanges, and bottom plates disposed symmetrically with respect to a transverse axis extending transversely of said longitudinal axis, said bottom plates interconnecting the lower flanges of said U-profile bars, each bottom plate having an opening for engagement by a locking member for securing said tank container to a vehicle loading area.

2. The tank container of claim 1, wherein said longitudinal fork lift channels are interrupted by a pair of gaps to define a pair of transverse fork lift channels extending parallel and symmetrically to said transverse axis.

3. The tank container of claim 2, wherein each end frame includes upper and lower transverse bars and the three profile bar portions formed by said pair of gaps in each said longitudinal fork lift channel are connected at their respective ends to said lower transverse bars of and to lower bearing plates of support members connected to said tank.

4. The tank container of claim 3, further including intermediate bearing plates, one mounted on said tank between each pair of support members disposed on the same line parallel to said transverse axis, the lower surfaces of all said bearing plates being flush with the upper confining plane of the respective transverse fork lift channel.

5. The tank container of claims 1, further including locking plates provided at the lower side of each end frame, each locking plate having a plurality of openings at mutual center spacing of substantially 140 mm for selective engagement by locking members for securing said container to a vehicle loading area.

6. The tank container of claim 5, wherein said locking plates are spaced in the direction of said longitudinal axis by substantially 2,260 mm as measured between the centers of the respective openings.

7. The tank container of claim 5, wherein the outer end of each locking plate is aligned with the farthest projecting portion of said tank container, and the inner end of each locking plate is in the area of said longitudinal axis.

8. The tank container of claim 7, wherein said farthest projecting portion of said tank container is constituted by a dump body stud, and an outer portion of said locking plate extending beyond the width of said end frame is adapted to be folded upwardly.

9. The tank container of claims 1, wherein a portion of said upper transverse bar of each end frame is formed as a grappler arm pocket provided with an upwardly extending guide plate.

10. The tank container of claim 9, wherein the upper portion of said guide plate has an eye reinforced by a transverse member for engagement by a crane hook.

11. The tank container of claim 10, wherein said transverse member constitutes the apex of a triangular support structure, of which the base is formed by the upper transverse bar of said end frame, one leg is formed by said guide plate and the other leg is formed by connecting plates fixed to said upper transverse bar.

* * * * *